US007758216B2

(12) United States Patent
Small

(10) Patent No.: US 7,758,216 B2
(45) Date of Patent: Jul. 20, 2010

(54) DECORATIVE LAMP ILLUMINATIONS STRUCTURE

(76) Inventor: Robert Small, 2561 Columbine Ct., Park City, UT (US) 84060

( * ) Notice: Subject to any disclaimer, the term of this patent is extended or adjusted under 35 U.S.C. 154(b) by 445 days.

(21) Appl. No.: 11/975,531

(22) Filed: Oct. 18, 2007

(65) Prior Publication Data

US 2008/0094844 A1 Apr. 24, 2008

Related U.S. Application Data

(60) Provisional application No. 60/852,636, filed on Oct. 18, 2006.

(51) Int. Cl.
*F21V 5/06* (2006.01)

(52) U.S. Cl. ..... 362/311.13; 362/457

(58) Field of Classification Search ..... 362/277, 362/281, 283, 309, 311.01, 311.13, 457
See application file for complete search history.

(56) References Cited

U.S. PATENT DOCUMENTS

| | | | | |
|---|---|---|---|---|
| D65,374 | S | 8/1924 | Katz | |
| 1,531,578 | A * | 3/1925 | Ruttenberg | 362/311.13 |
| 1,929,315 | A | 5/1933 | Johnson et al. | |
| 2,681,981 | A * | 6/1954 | Wilson | 248/230.7 |
| 3,943,353 | A | 3/1976 | Tada | |
| 5,408,396 | A | 4/1995 | Stanley | |
| 5,611,618 | A | 3/1997 | Sawyer | |
| 5,833,349 | A * | 11/1998 | Apple | 362/311.13 |
| 6,010,235 | A | 1/2000 | Sawyer | |
| 6,079,855 | A | 6/2000 | Azeredo et al. | |
| 6,494,589 | B1 | 12/2002 | Shyu | |
| 6,523,978 | B1 | 2/2003 | Huang | |
| 6,854,868 | B2 | 2/2005 | Wu | |
| 6,971,773 | B2 | 12/2005 | Pape et al. | |
| 2004/0141328 | A1 * | 7/2004 | Stone et al. | 362/457 |
| 2004/0165376 | A1 | 8/2004 | Wu | |
| 2005/0254242 | A1 | 11/2005 | Baker | |
| 2007/0263397 | A1 * | 11/2007 | Nielson | 362/457 |

* cited by examiner

*Primary Examiner*—David V Bruce
(74) *Attorney, Agent, or Firm*—Clayton, Howarth & Cannon, P.C.

(57) ABSTRACT

An apparatus and method is disclosed for enhancing the aesthetic appearance of lamps. A support structure may be provided for attaching to the lamp. The support structure may be attached in a manner such that the support structure may be hidden from view by the lamp shade. The support structure may be versatile to be attached to lamps of various different configurations. One or more decorative ornaments may be attached to the support structure for enhancing the appearance of the lamp. The ornaments may be removed and interchanged with other decorations such that the lamp may be decorated differently for different occasions.

36 Claims, 8 Drawing Sheets

DECORATIVE LAMP ILLUMINATIONS STRUCTURE

CROSS-REFERENCE TO RELATED APPLICATIONS

This application claims the benefit of U.S. Provisional Application No. 60/852,636, filed Oct. 18, 2006, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to illumination devices and methods, and more particularly, but not necessarily entirely, to structures and methods for enhancing the aesthetic features of lamps.

2. Description of Related Art

Lamps of various different sizes and configurations are commonly used to enhance the aesthetic appearance of a space, as well as to provide light. Such lamps often have various different types of ornamentation. Sometimes ornamentation is provided on the lamp itself, whereas in other situations, ornamentation may be provided as part of the lamp shade. In most cases, the ornamentation is fixed to the lamp such that the appearance of the lamp is constant. However, it is often desirable to alter the decor of a space. For example, it may be desirable to alter the decor of a space to correspond with different occasions, holidays, or seasons. Moreover, it may be desirable to alter colors of the lamp to correspond to different furnishings.

It would be an advantage to provide an illumination system that allows the appearance of a lamp to be altered to correspond with different settings or occasions without completely replacing the lamp. Moreover, it would be an advantage to provide a method and system for providing custom arranged decorations for a lamp.

The prior lamp devices are characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description that follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
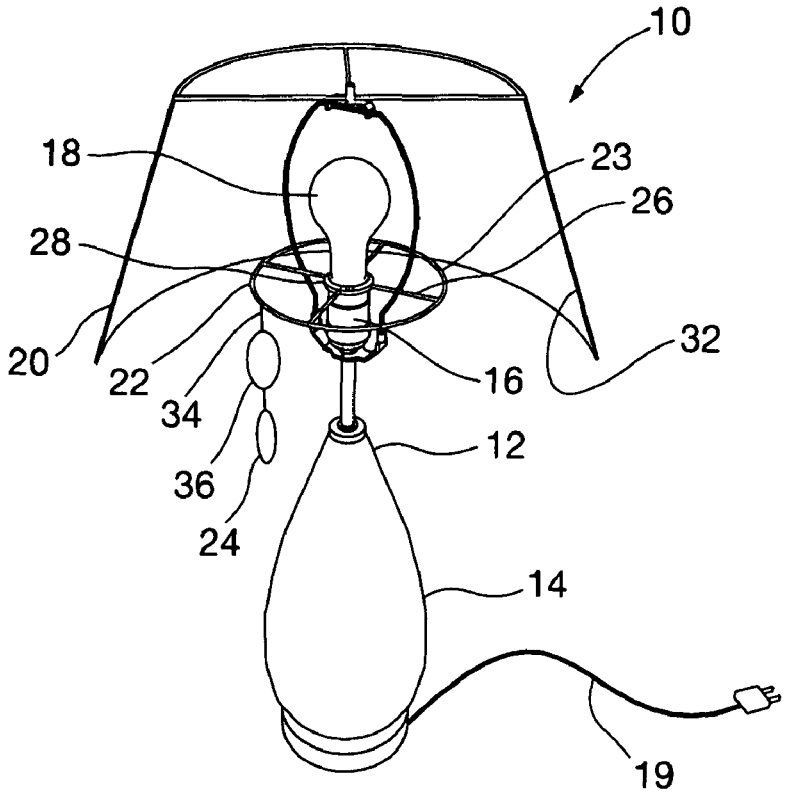
FIG. 1 is a perspective view of one embodiment of an illumination system in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present devices and methods for enhancing the aesthetic features of lamps are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

It must be noted that, as used in this specification and the appended claims, the singular forms "a," "an," and "the" include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

As used herein, the phrase "diffusing structure" shall be construed broadly to include various devices for interacting with light such as by shading, directing, reflecting or allowing light to pass therethrough. Accordingly, "diffusing structures" include, but are not limited to, shades.

As used herein, the term "concentric" shall be construed to include objects having a common center or a common central axis. Accordingly, objects such as a plurality of loops may be considered to be concentric if they reside in the same plane or if they reside in different planes with a common central axis.

Figure 2:
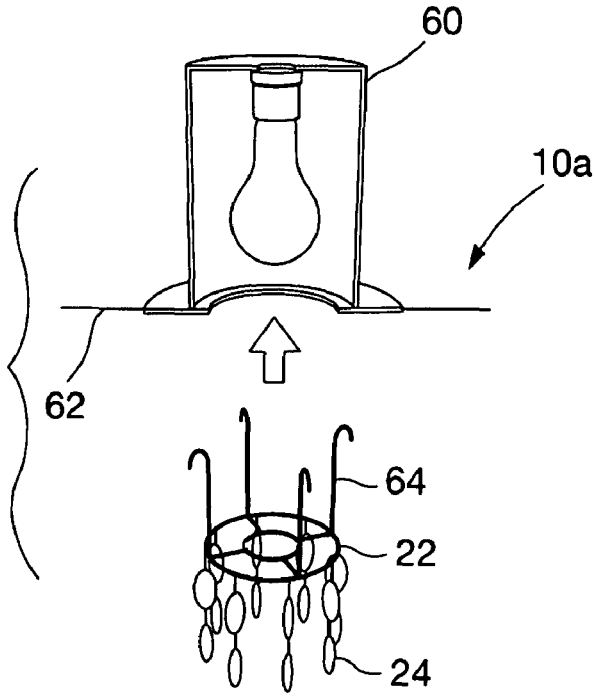
FIG. 2 is a perspective view of an alternative embodiment illumination system in a ceiling.

Referring now to FIG. 1, a perspective view is shown of one embodiment of an illumination system, indicated generally at 10, in accordance with the principles of the present disclosure. The illumination system 10 may include a lamp 12 formed in any manner known to those skilled in the art. For example, the lamp 12 may be configured to be placed on a table, or the lamp 12 may be configured to be supported on the floor, or the lamp 12 may be suspended from a wall (such as a sconce) or ceiling (such as a chandelier). Moreover, the lamp 12 may have any variety of shapes, sizes or configurations without departing from the scope of the present disclosure. Alternatively, the illumination system 10*a* may be part of a ceiling lamp or light, as shown in FIG. 2, and discussed more fully below. For ease in describing the present disclosure, the term "lamp" is used in this detailed description to refer to any structural component used as an artificial source of visible illumination and may be any variety of shapes, sizes or configurations without departing from the scope of the present disclosure. However, it will be understood that unless the context clearly dictates otherwise, any suitable known structural component used as an artificial source of visible illumination may be utilized by the present disclosure.

The lamp 12 may include a base 14 in any configuration known in the art for supporting the lamp 12 and/or providing a decorative appearance. It will be understood that some embodiments of the lamp 12 may be formed without a base 14. A socket 16 may be supported on the base 14, or a member extending from the base 14, for receiving a light source 18, such as a light bulb. It will be understood that the light source 18 may also include multiple bulbs, one or more light emitting diodes (LEDs), or one or more fiber optic strands or sprays, for example. For ease in describing the present disclosure, the phrase "light bulb" is commonly used synonymously with "light source." However, it will be understood that unless the context clearly dictates otherwise, any suitable known light source may be used instead of a light bulb.

It will be understood that the socket 16 may have any suitable size and configuration known in the art for receiving a corresponding light bulb. The lamp 12 may include a cord 19 for connecting to an electrical outlet for providing electrical power to the lamp 12 in a manner known in the art. Moreover, other embodiments of the present disclosure may be provided with a battery or some embodiments may be provided in which the light source 18 may be a flame or other illumination device, such that external electrical power may not be needed.

The lamp 12 may also include a diffusing structure or shade 20 configured in any manner known in the art. For example, the shade 20 may be made of a translucent or opaque material, for shielding the glare of the light source 18, or for directing the light to a particular area. The shade 20 may be formed in various different sizes, shapes and configurations within the scope of the present disclosure. Further, the shade 20 may be attached to the base 14 or other portion of the lamp 12 in any suitable manner known in the art.

In accordance with the principles of the present disclosure, a support structure 22 may be provided to be attached to the lamp 12 for supporting one or more decorative items 24, also referred to as illumination structures 24. One embodiment of the support structure 22 may be configured to be removably attachable to the lamp 12 to be interchangeable with other support structures 22. An alternative embodiment support structure 22 may be fixedly attached to a portion of the lamp 12 as a permanent part of the lamp 12, such that the support structure 22 may not be removable from the lamp 12. For example, the support structure 22 may be fixedly attached to the lamp base 14, the socket 16 or the shade 20 without departing from the scope of the present disclosure.

Referring to FIG. 3-12, the support structure 22 may be formed in various different sizes and shapes suitable for use with the lamp 12. For example, one embodiment of the support structure 22 may be formed as a frame of one or more support members 23 (see for example FIGS. 3 and 7). The support members 23 may be configured as substantially rigid loops supported by internal braces 26 (see for example FIGS. 3 and 7). One embodiment of the support structure 22 may include the support members 23 that may be substantially rigidly held in place by the braces 26. Other embodiments of the support structure 22 may be formed of flexible support members 23. It will be appreciated that using flexible support members 23 may permit a user to more easily move the support structure 22, for example to clean the inside of the shade 20 without removing the shade 20, or to turn the lamp 12 power switch on and off, whether the switch is a manual switch that may be twisted or pushed, or a pull chain, or other on and off switches that are known in the art.

Figure 3:
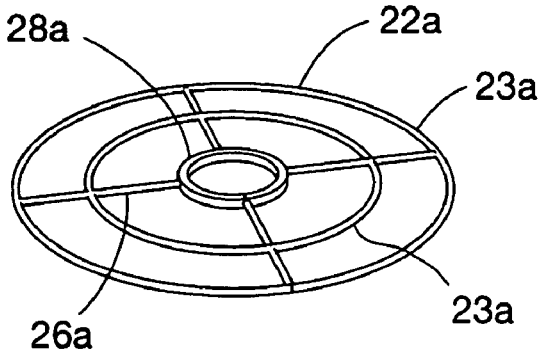
FIG. 3 is a perspective view of one embodiment of a support structure useful as part of the illumination system of FIG. 1.
Figure 4:
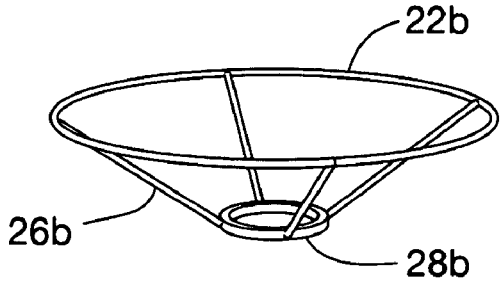
FIG. 4 is a perspective view of an alternative embodiment support structure useful as part of the illumination system of FIG. 1.

Referring specifically to FIGS. 3 and 4, the support structure 22*a* may have a plurality of support members 23 forming concentric loops of circular shapes (see FIG. 3) or the support structure 22 may comprise any other shape, such as polygonal, linear, or irregular shapes. Moreover, the support structure 22 may be a substantially planar member, or the support structure 22 may form a three-dimensional support structure 22*b*, such as a frusto-conical shape as shown most clearly in FIG. 4. Accordingly, the support structure 22 may be formed in any suitable configuration.

It will be understood that the drawings include representations of various embodiments of the present disclosure. The reference numerals used to designate structures in the different embodiments are sometimes related. For example, as used herein, when referring to a support structure in general, the reference numeral 22 may be used, whereas specific embodiments may be referred to by the reference numeral 22 followed by a letter, such as support structure "22*a*." However, unless the context clearly dictates otherwise, claims drawn to such features refer to the feature in general, including all the different embodiments disclosed.

One embodiment of the support structure 22 may be configured to attach to the socket 16 of the lamp 12. Accordingly, the support structure 22 may have an internal support 28 configured to encompass or be supported in or on the socket 16. The light bulb 18 may be configured to be received through the internal support 28 to maintain the support structure 22 on the socket 16, as illustrated, for example, in FIG. 1.

Figure 5:
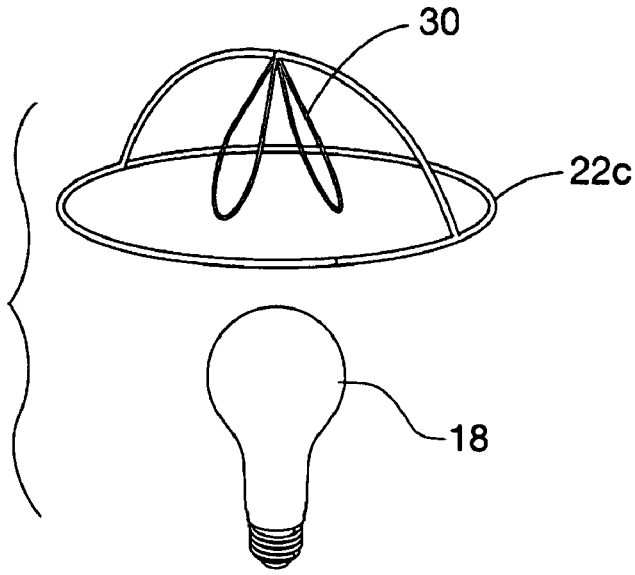
FIG. 5 is an exploded perspective view of another alternative embodiment support structure and a light bulb useful as part of the illumination system of FIG. 1.
Figure 6:
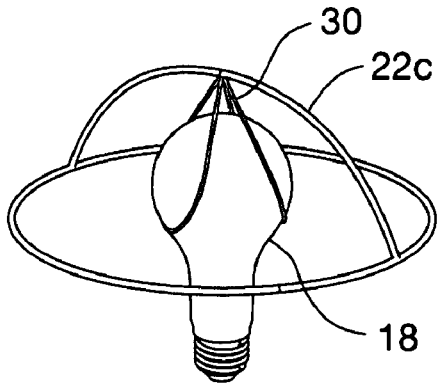
FIG. 6 is a perspective view of the support structure and light bulb of FIG. 5, with the support structure attached to the light bulb.

Alternatively, as shown in FIGS. 5 and 6, the support structure 22*c* may be configured to attach to the light bulb 18. The support structure 22*c* may include a receiving member 30 sized to receive the light bulb 18 to thereby attach the support structure 22*c* to the lamp 12. The receiving member 30 may be configured to resiliently flex to receive and grip the light bulb 18, or the receiving member 30 may be sized to support the support structure 22*c* on top of or around the light bulb 18 without applying pressure to grip the light bulb 18.

It is to be understood that one or more illumination structures 24 may be joined to the support structure 22. The illumination structures 24 may be formed of any suitable material and may be sized, shaped and configured to decorate the lamp 12. For example, the illumination structure 24 may be configured as a flexible member having a plurality of beads. Alternatively, the illumination structure 24 may be formed in various different decorative shapes or ornamentations. For example, the illumination structures 24 may be formed of ornaments suitable for a particular season or occasion, such as Christmas shapes of trees, canes, animals, or the like. Illumination structures 24 of different shapes and colors may be used for different occasions and holidays. Accordingly, the illumination structures 24 may be formed in any desired shape and configuration without departing from the spirit or scope of the present disclosure.

One embodiment of the illumination structures 24 may be formed of translucent materials, such as glass or plastic, such that the illumination structures 24 may interact with the light from the light source 18 to provide ornamentation to the lamp 12. The illumination structures 24 may also be formed of various different colors to enhance or be complementary with the decor of various different settings. Other illumination structures 24 may be formed of opaque materials, or reflective materials, such as metals, or painted materials, for example. It will also be understood that some embodiments of the illumination structures 24 may be configured to provide ornamentation to the lamp 12 regardless of whether or not the light source 18 is activated to shine light on the illumination structures 24. Accordingly, as used herein, the phrase "illumination structure" is not limiting of the structure to require illumination.

Figure 12:
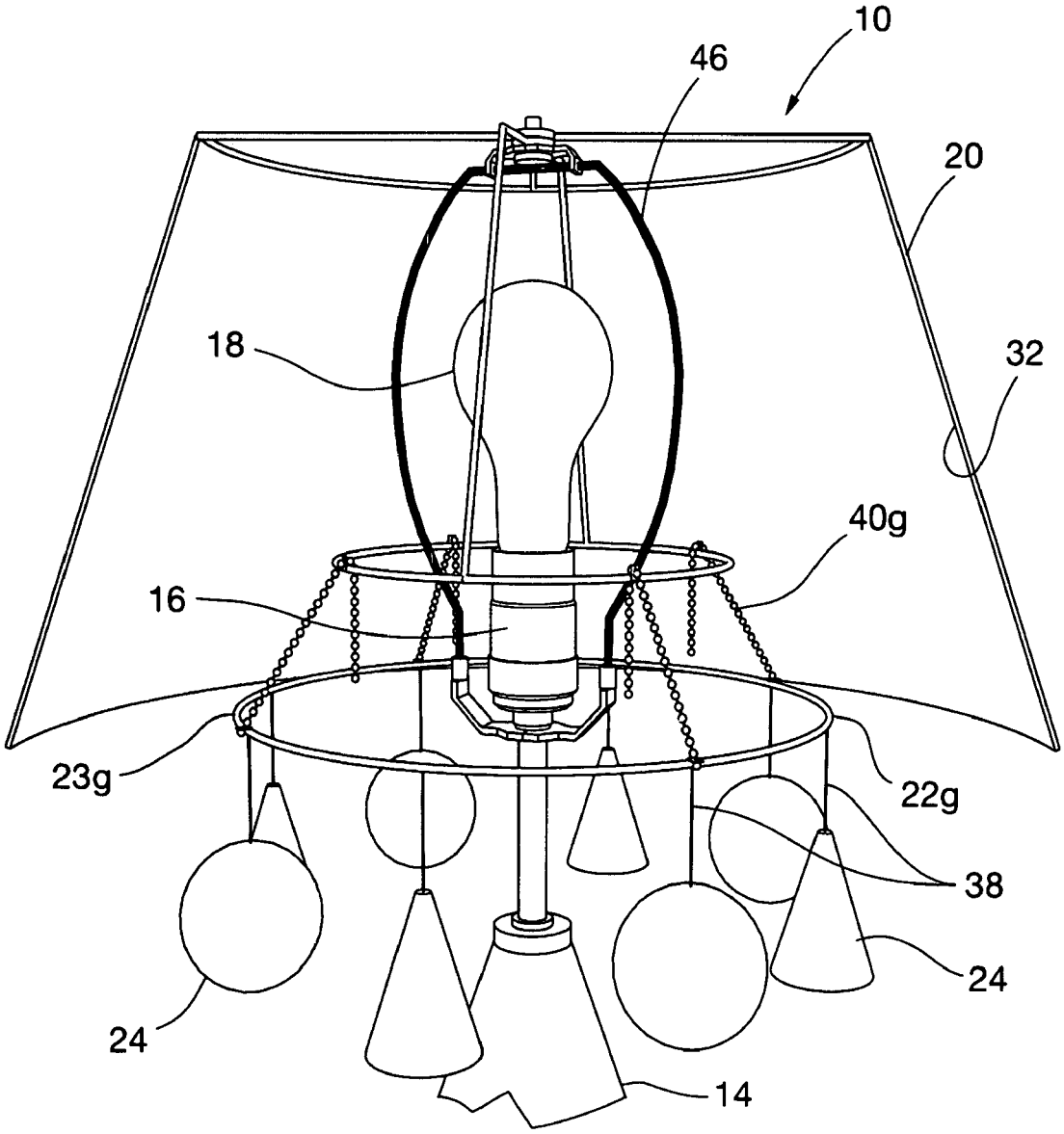
FIG. 12 is a break-away perspective view of an illumination system including an additional alternative embodiment support structure.
Figure 13:
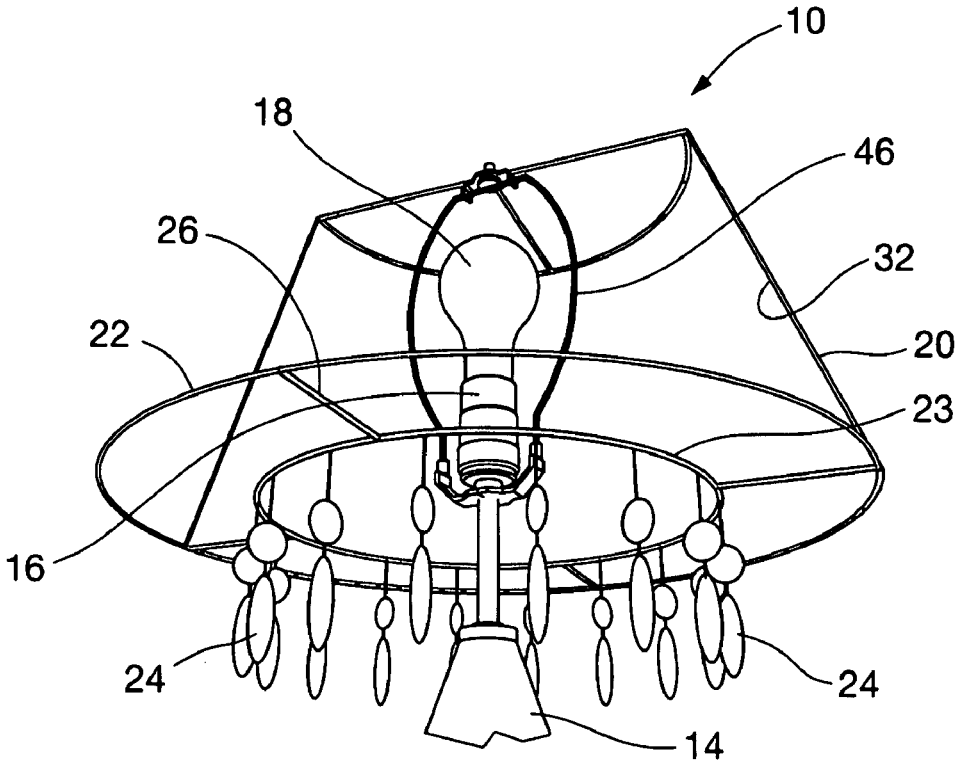
FIG. 13 is a break-away perspective view of an illumination system including an embodiment of a support structure attached to a shade and made in accordance with the principles of the present disclosure.
Figure 14:
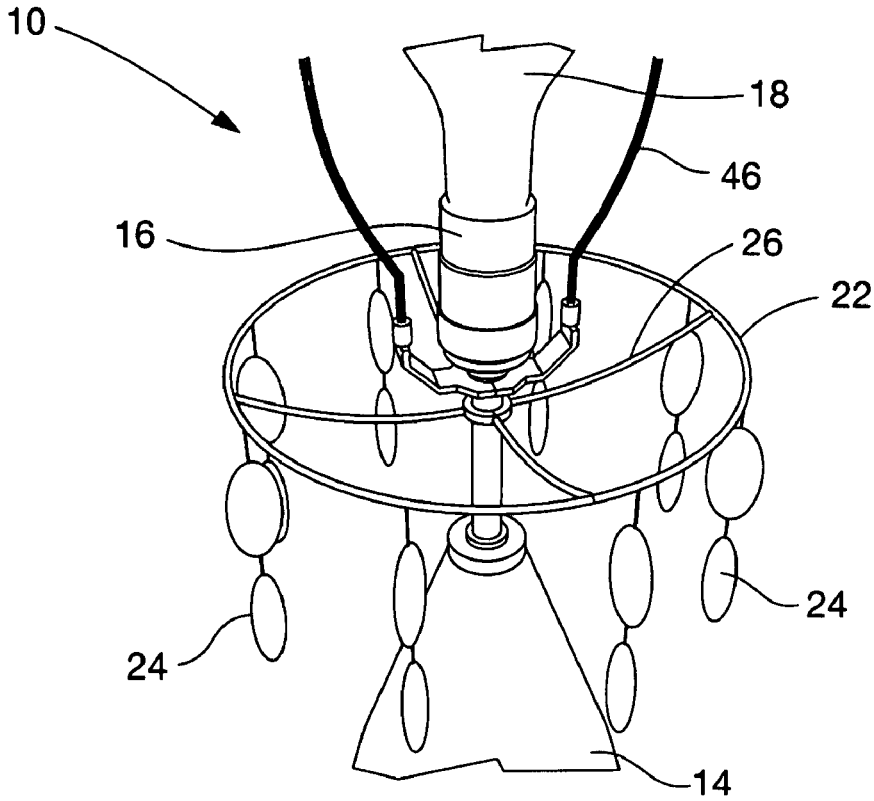
FIG. 14 is a perspective view of an illumination system including an embodiment of a support structure.

The illumination structure 24 may also include a connector 38 for joining the illumination structure 24 to the support structure 22 (illustrated best in FIG. 12). The connector 38 may be formed as a hook, clasp, clip, tie, snap, deformable member, magnet or any other suitable mechanism known to those skilled in the art for joining one member to another. Accordingly, the illumination structure 24 may be removably joined to the support structure 22 such that the illumination structure 24 may be positioned and set in a desired location on the support structure 22 or the illumination structure 24 may be interchanged with other illumination structures 24 to provide a desired appearance of the lamp 12. Moreover, the illumination structures 24 may be interchanged with different support structures 22 or lamps 12 such that the principles of the present disclosure can be used to provide a versatile and changeable illumination system 10. The configuration of the support structure 22 may be well suited to provide substantially infinite possibilities of locations for positioning different combinations and quantities of illumination structures 24.

Alternatively, it will be understood that some embodiments of the present disclosure may include illumination structures 24 that may be fixedly joined to the support structure 22, such as by welding or bonding, for example. Moreover, other alternative embodiments may include illumination structures 24 that may be integrally formed with the support structure 22.

It will be understood that one embodiment of the present disclosure may include a support structure 22 that may be configured to reside within, inside of, or within the confines of the shade 20, such that the support structure 22 may be hidden from view (best illustrated in FIG. 1). For example, the shade 20 may define an interior space 32 for receiving the light source 18 therein. The illumination structure 24 may be removably joined to the lamp 12 such that at least one illumination structure 24 may be spaced apart from the shade 20 and a first portion of 34 the illumination structure 24 may be received in the interior space of the shade 20, and a second portion 36 of the illumination structure may extend outside of the interior space of the shade 20, for example, beneath the shade 20 (see FIG. 1).

It will be understood that other embodiments of the support structure 22 may be configured for attachment to the lamp 12 that may be visible above, below, or on an exterior of the shade 20 without departing from the spirit or scope of the present disclosure. Still other alternative embodiments of the support structure 22 may be configured to be used with a lamp 12 that does not include a shade 20. Further, other embodiments of the support structure 22 may include attaching the support structure itself directly to the shade 20 using a variety of attachment mechanisms known to those of skill in the art. For example, it will be appreciated that the support structure 22 may be directly attached to an interior portion of the shade 20 using clips or other attachment mechanisms.

Specific reference will now be made to FIGS. 7-8 to describe an additional embodiment of the present disclosure. As previously discussed, the presently preferred embodiments of the disclosure illustrated herein are merely exemplary of the possible embodiments of the disclosure, including that illustrated in FIG. 7.

Figure 7:
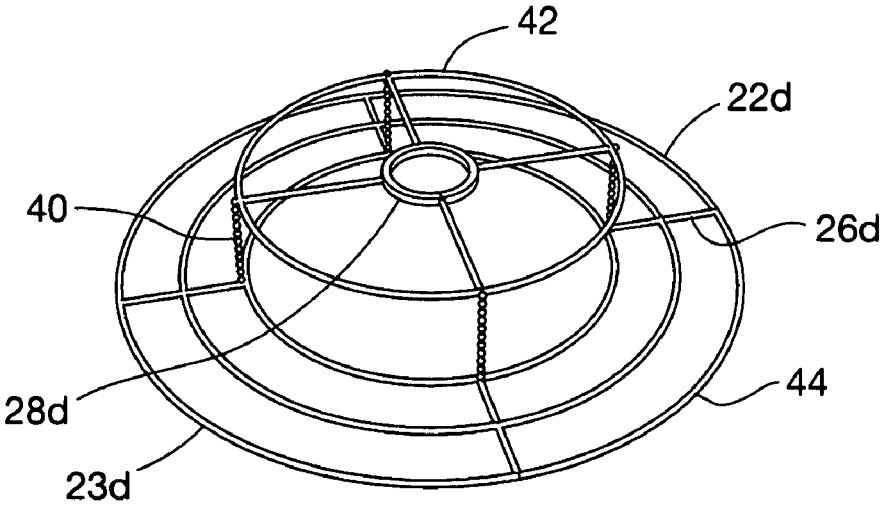
FIG. 7 is a perspective view of an alternative embodiment support structure useful as part of the illumination system of FIG. 1.

It will be appreciated that the embodiment of the disclosure illustrated in FIG. 7 contains many of the same structural features represented in FIGS. 1-6. New or different structures will be explained to most succinctly describe the additional advantages that come with the embodiment of the disclosure illustrated in FIG. 7. FIG. 7 depicts a perspective view of a support structure 22*d*. The support structure 22*d* may include a plurality of connecting members 40 connecting a first portion 42 of the support structure 22*d* with a second portion 44 of the support structure 22*d*. The connecting members 40 may be flexible members, such as chains, or cords, for example, for removably and adjustably joining the first portion 42 of the support structure 22*d* to the second portion 44 of the support structure 22*d*. Accordingly, the support structure 22*d* may be versatile for use in different sized lamps, or with different quantities of illumination structures 24. Further, the flexibility of the connecting members 40 may also aid a user when turning the light on and off or when cleaning the inside of the shade 20 without removing the shade 20 from the lamp 12, as a user's hand is placed inside the interior of the shade 20 thereby allowing the support structure 22 to move or flex.

It will be understood that the connecting members 40 may be attached to the first portion 42 of the support structure 22*d* and to the second portion 44 of the support structure 22*d* in any manner known in the art. Similarly, the length of the connecting members 40 may be adjustable in any manner known to those skilled in the art for varying the distance from the first portion 42 of the support structure 22*d* to the second portion 44 of the support structure 22*d*. Accordingly, as shown in FIG. 8, which shows a break-away perspective view of a lamp 12 with the support structure 22*d* attached, the support structure 22*d* may provide various different configurations and locations for attaching the illumination structures 24.

Figure 8:
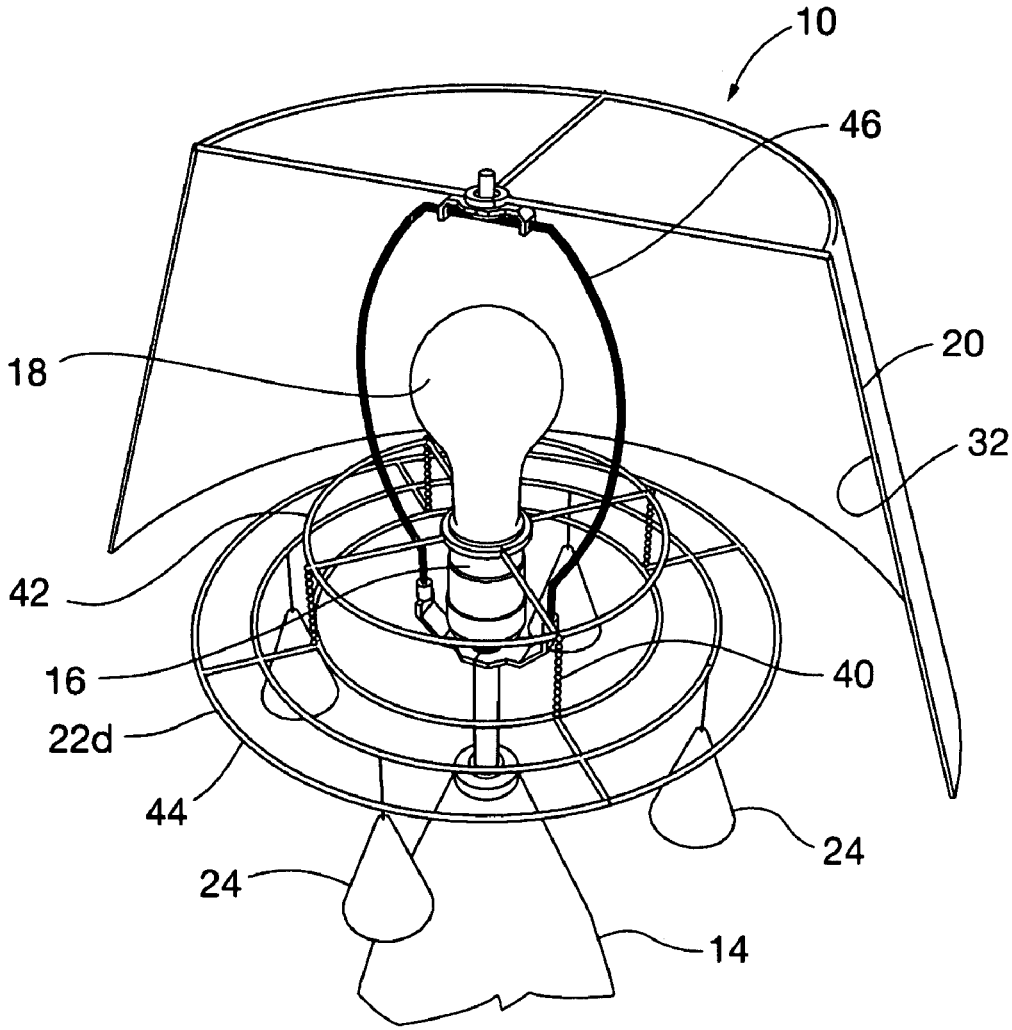
FIG. 8 is a break-away perspective view of an illumination system including the support structure of FIG. 7.

As shown in FIG. 8, the shade 20 may be attached to the base 14 through a harp 46, in a manner known in the art. It will be understood that the harp 46 may be removed from the base 14 and the support structure 22*d* may be attached to the socket 16. The harp 46 may then be replaced on the base 14 such that the support structure 22*d* can be used without interfering with the customary use of the shade 20.

Figure 9:
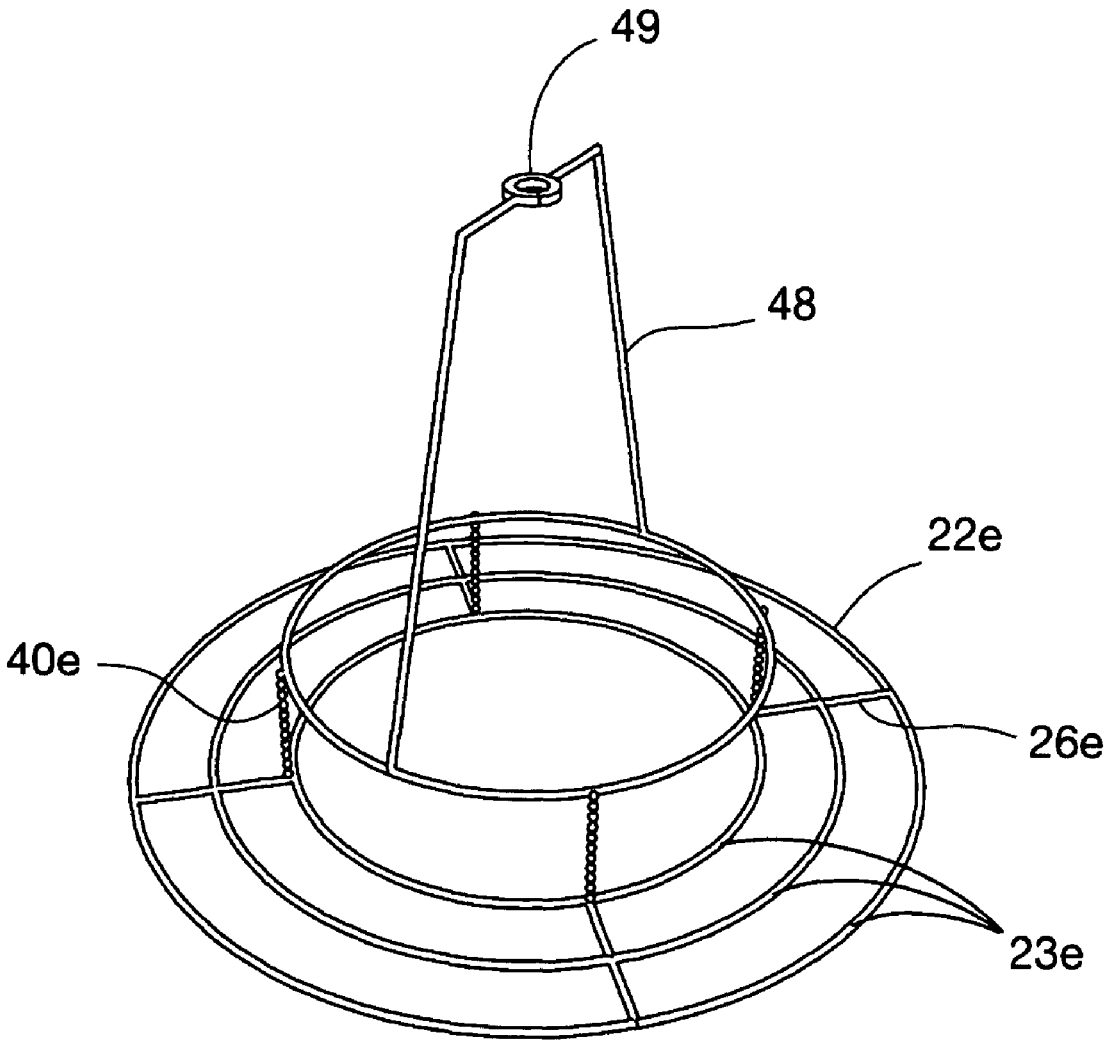
FIG. 9 is a perspective view of another alternative embodiment support structure useful as part of the illumination system of FIG. 1.

Reference will now to made to FIG. 9 to describe an additional embodiment of the present disclosure. As previously discussed, the presently preferred embodiments of the disclosure illustrated herein are merely exemplary of the possible embodiments of the disclosure, including that illustrated in FIG. 9.

It will be appreciated that the embodiment of the disclosure illustrated in FIG. 9 contains many of the same structures represented in FIGS. 1-8. New or different structural features will be explained to most succinctly describe the additional advantages which come with the embodiment of the disclosure illustrated in FIG. 9. FIG. 9 depicts a perspective view of a support structure 22*e*. The support structure 22*e* may include a support harp 48 for attaching to the harp 46 of the lamp 12 or lamp shade 20. The support harp 48 may include a receiver 49 for receiving a threaded stud or pin that is customarily provided on the harp 46 and for attaching the support structure 22*e* to the harp 46. Accordingly, the support structure 22*e* may be attachable to the lamp 12 without being attached to the socket 16, or the light bulb 18.

It will be understood that any other suitable attachment mechanism may be used to join the support structure 22 to the lamp 12. For example, substantially rigid, flexible or resilient members may be used to attach the support structure 22 to the lamp 12. One embodiment of an attachment mechanism between the support structure 22 and the lamp 12 may include an elastic member surrounding the shade 20, which may be attachable to the support structure 22. Thus, the support structure 22 may be attached to the shade 20 itself or any other part of the lamp 12 without departing from the spirit or scope of the present disclosure. Moreover, other embodiments may include support structures 22 that may be attached to any portion of the lamp 12, such as the base 14, the shade 20 or shade support struts, or a shaft below the socket 16 above the base 14.

Figure 10:
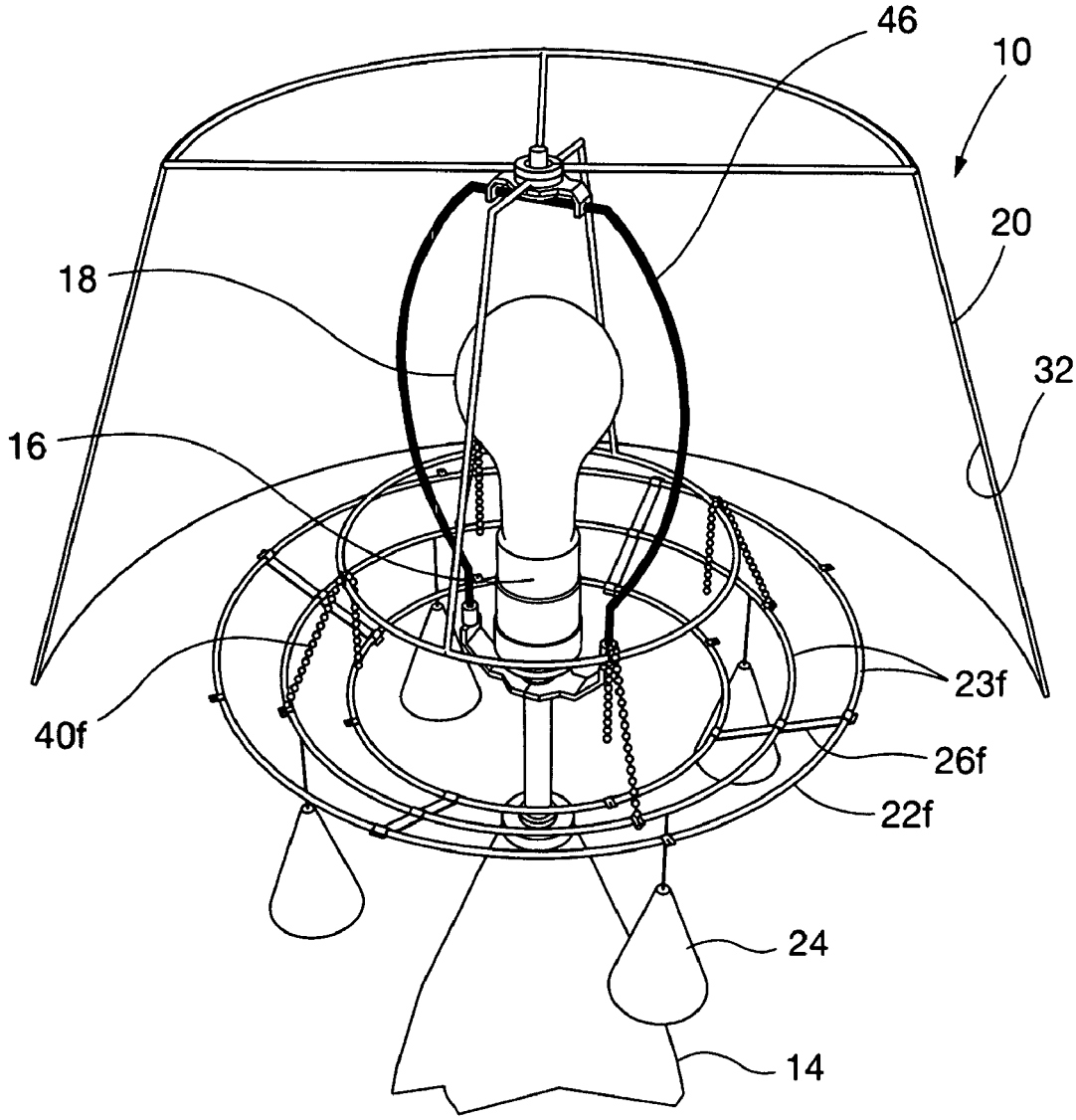
FIG. 10 is a break-away perspective view of an illumination system including another alternative embodiment support structure.

An exemplary depiction of a connection between the support structure 22 and the harp 46 is depicted in FIG. 10, which shows a break-away perspective view of a lamp 12 with yet another embodiment of a support structure 22*f* attached to the harp 46. As previously discussed, the presently preferred embodiments of the disclosure illustrated herein are merely exemplary of the possible embodiments of the disclosure, including that illustrated in FIG. 10.

It will be appreciated that the embodiment of the disclosure illustrated in FIG. 10 contains many of the same structural features represented in FIGS. 1-9. New or different structures will be explained to most succinctly describe the additional advantages which come with the embodiment of the disclosure illustrated in FIG. 10. The support structure 22*f* may include internal braces 26*f* which may be movably connected to the support members 23*f*. Accordingly, the support members 23*f* may be movable with respect to each other in an upward or downward direction to thereby enhance the versatility of the support structure 22*f*. One embodiment of the braces 26*f* may allow the support members 23*f* to be removably joined to the support structure 22*f*. For example, the support members 23*f* may be snapped on or off to create a support structure 22*f* of a different configuration.

Figure 11:
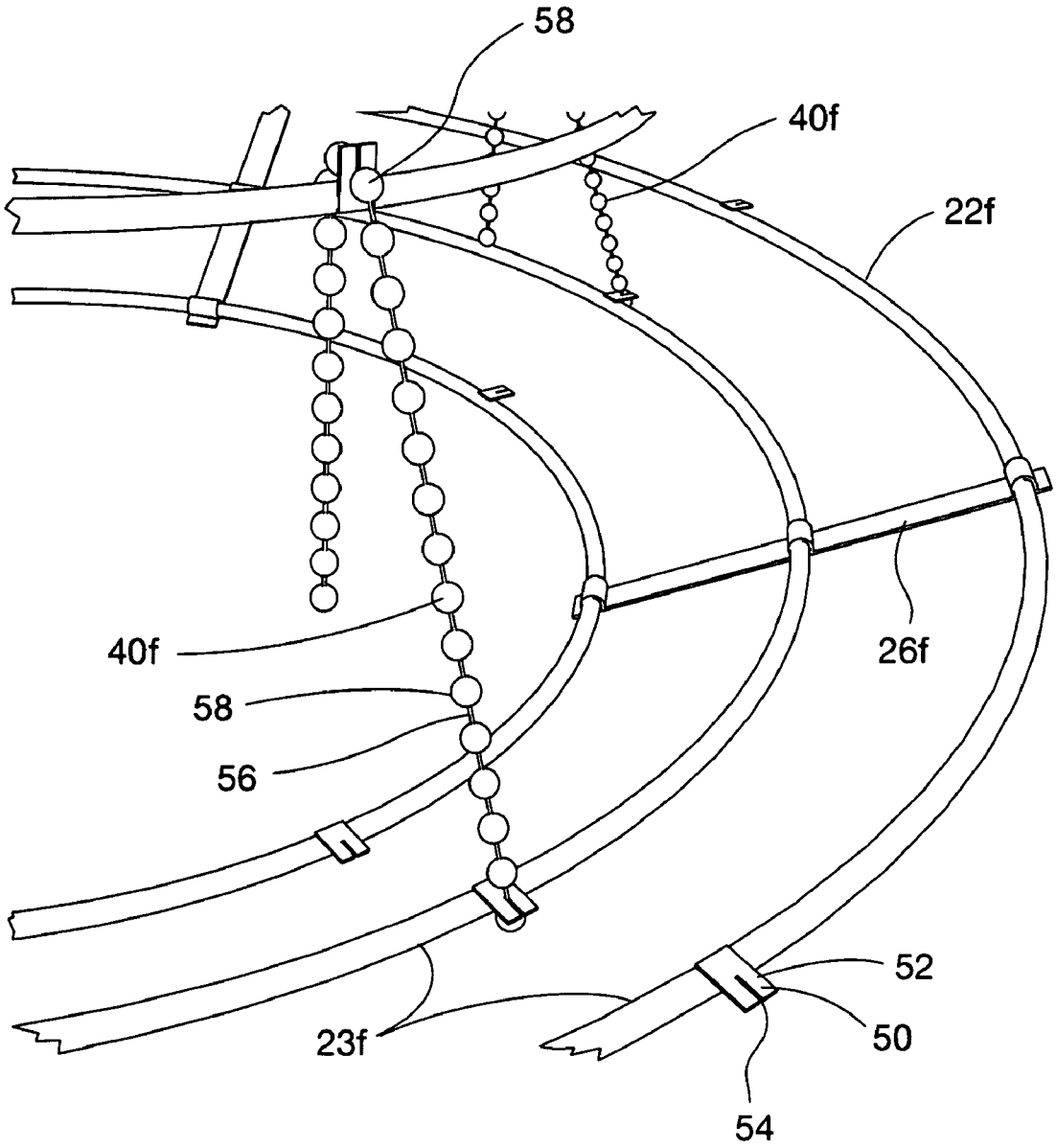
FIG. 11 is an enlarged break-away perspective view of the support structure of FIG. 10.

As shown most clearly in FIG. 11, which illustrates an enlarged break-away perspective view of the support structure 22*f*, the support structure 22*f* may include a plurality of attachment features 50 for connecting the connecting members 40*f*. The attachment features 50 may be formed as a wall 52 defining a slot 54 for receiving a narrow portion 56 of the connecting members 40*f*. It will be understood that enlarged portions 58 of the connecting members 40*f* may be blocked by the wall 52 from passing through the slot 54 such that the connecting members 40*f* may be movably attached to any of the attaching features 50 such that the support structure 22*f* may be joined to the lamp 12 in different configurations. For example, if the connecting members 40*f* are attached to the interior support members 23*f*, the exterior support members 23*f* may move downward with respect to the interior support members 23 due to the force of gravity. Alternatively, if the connecting members 40*f* are attached to the exterior support members 23*f*, the interior support members 23*f* may move downward with respect to the exterior support members 23*f* thereby creating a support structure 22*f* having a different configuration.

It will also be understood that the length of the connecting members 40*f* may be adjusted by inserting different lengths of the connecting members 40*f* in the attachment features 50 to arrive at a support member 22*f* of a desired configuration. It will be understood that the various different mechanisms may be used to form the attachment features 50 and such mechanisms fall within the scope of the present disclosure, in addition to or instead of the structures disclosed herein. Accordingly, it will be understood that the connecting members 40*f* and attachment features 50 are merely representative of the numerous different structures possible for providing an adjustable connection mechanism contemplated by the present disclosure and such structures fall within the scope of the present disclosure.

An exemplary depiction of yet another embodiment of a support structure 22*g* is depicted in FIG. 12, which illustrates a break-away, perspective view of a lamp 12 with the support structure 22*g* attached. As previously discussed, the presently preferred embodiments of the disclosure illustrated herein are merely exemplary of the possible embodiments of the disclosure, including that illustrated in FIG. 12.

It will be appreciated that the embodiment of the disclosure illustrated in FIG. 12 contains many of the same structural features represented in FIGS. 1-11. New or different structures will be explained to most succinctly describe the additional advantages which come with the embodiment of the disclosure illustrated in FIG. 12. The support structure 22*g* may be configured similar to the support structure 22*f* in FIG. 10, except that only a single lower support member 23*g* may be provided. Accordingly, it will be understood that any number of support members 23 may be provided as part of the support structure 22 and such various configurations fall within the scope of the present disclosure. It will also be understood that in FIG. 12, the support member 23*g* is depicted in an embodiment that is attached to the harp 46 of the lamp 12. However, the single lower member embodiment may be configured to be attachable to the lamp 12 using any other attachment mechanism, such as by attachment to the socket 16 or the light bulb 18, for example.

It will be understood that the principles of the present disclosure may also be used in connection with a ceiling lamp 60 as shown in the illumination system 10*a* of FIG. 2. For example, one embodiment of the ceiling lamp 60 may include a canned light recessed in and with respect to a ceiling 62. It will be understood that other embodiments of the present disclosure may be suitable for ceiling lamps that hang below the ceiling 62. It will be understood that the support structure 22 may be attached to the ceiling lamps 60 using attachment devices 64, such as hooks, straps, adhesive strips, or any other suitable attachment device known in the art. One embodiment of the attachment devices 64 may include hooks that may be attached on an interior of the ceiling lamp 60 such that the support structure 22 hangs beneath the ceiling lamp 60. The illumination structures 24 may then be attached to the support structure 22 in any manner as discussed above.

It will be understood that the structures described herein may be manufactured of any suitable materials using any suitable manufacturing process known to those skilled in the art.

It will be appreciated that the structures and apparatus disclosed herein are merely exemplary of means for attaching a support structure to a lamp, and it should be appreciated that any structure, apparatus or system for attaching a support structure which performs functions the same as, or equivalent to, those disclosed herein are intended to fall within the scope of a means for attaching a support structure, including those structures, apparatus or systems for attaching which are presently known, or which may become available in the future. Anything which functions the same as, or equivalently to, a means for attaching a support structure to a lamp falls within the scope of this element.

In accordance with the features and combinations described above, a useful method for decorating a lamp, the lamp comprising a base, a light source and a shade, includes the steps of:

joining a support structure to the lamp;

removably joining at least one illumination structure to the support structure; and placing the shade over the support structure such that the at least one illumination structure is visible beneath the shade.

Those having ordinary skill in the relevant art will appreciate the advantages provide by the features of the present disclosure. For example, it is a feature of the present disclosure to provide a method for decorating a lamp that is simple to accomplish. Another feature of the present disclosure to provide such a method for decorating a lamp that is versatile such that the decorations can be interchanged with various different lamps, and that various different decorations may be used. It is a further feature of the present disclosure, in accordance with one aspect thereof, to provide a decorative illumination system that has enhanced aesthetic qualities.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method for decorating a lamp, said lamp comprising a light source and a diffusing structure, said method comprising:

joining a support structure to said lamp;

removably joining at least one illumination structure to said support structure; and placing said diffusing structure over said support structure such that said at least one illumination structure is visible beneath said diffusing structure.

2. The method of claim 1, wherein joining said support structure to said lamp comprises joining said support structure to a socket on said lamp.

3. The method of claim 1, wherein joining said support structure to said lamp comprises joining said support structure to said light source.

4. The method of claim 1, wherein joining said support structure to said lamp comprises joining said support structure to a harp on said lamp.

5. The method of claim 1, wherein removably joining at least one illumination structure to said support structure comprises joining a plurality of illumination structures to said support structure such that said plurality of illumination structures are set with respect to each other and with respect to said support structure.

6. The method of claim 1, wherein said diffusing structure comprises a shade defining an interior space for receiving said light source therein, and wherein said at least one illumination structure is joined to said lamp such that a first portion of said at least one illumination structure is positioned within said interior space of said shade, and a second portion of said at least one illumination structure is positioned outside said interior space of said shade.

7. The method of claim 1, wherein said at least one illumination structure comprises a translucent member.

8. The method of claim 1, wherein said at least one illumination structure comprises at least one bead.

9. The method of claim 1, wherein removably joining at least one illumination structure to said support structure comprises hanging said at least one illumination structure from said support structure.

10. The method of claim 1, wherein said support structure comprises a first portion that is movable with respect to a second portion.

11. The method of claim 1, wherein said support structure comprises a plurality of support members forming concentric loops, and wherein said method further comprises selecting a position on said concentric loops for joining said at least one illumination structure.

12. The method of claim 1, wherein joining said support structure to said lamp comprises removably joining said support structure to said lamp.

13. The method of claim 1, wherein joining said support structure to said lamp comprises fixedly joining said support structure to a portion of said lamp such that said support structure is not removable from said portion of said lamp.

14. A method for decorating a lamp, said lamp comprising a light source and a shade, said shade defining an interior space for receiving said light source therein, said method comprising:

removably joining at least one illumination structure to said lamp such that said at least one illumination structure is spaced apart from said shade and a first portion of said at least one illumination structure is received in said interior space of said shade, and a second portion of said at least one illumination structure extends outside of said interior space of said shade beneath said shade.

15. The method of claim 14, further comprising joining a support structure to said lamp.

16. The method of claim 15, wherein joining said support structure to said lamp comprises one of a group consisting of joining said support structure to a socket on said lamp, joining said support structure to said light source, and joining said support structure to a harp on said lamp.

17. The method of claim 15, further comprising joining a plurality of illumination structures to said support structure.

18. The method of claim 15, wherein said support structure comprises a plurality of support members forming concentric loops, and wherein said method further comprises selecting a position on said concentric loops for joining said at least one illumination structure.

19. A method for decorating a lamp, said lamp comprising a light source and a diffusing structure, said method comprising:

providing a plurality of illumination structures and attaching said plurality of illumination structures to a support structure such that said plurality of illumination structures are disposed in a set position with respect to each other;

joining said support structure to said lamp such that said illumination structures are configured to be illuminated by said light source;

wherein said illumination structures are positioned independently of said diffusing structure and wherein said illumination structures and said support structure are interchangeable with other illumination structures, support structures and lamps.

20. The method of claim 19, wherein joining said support structure to said lamp comprises one of a group consisting of joining said support structure to a socket on said lamp, joining said support structure to said light source, and joining said support structure to a harp on said lamp.

21. The method of claim 19, wherein said diffusing structure comprises a shade defining an interior space for receiving said light source therein, and wherein said plurality of illumination structures are joined to said lamp such that a first portion of said plurality of illumination structures is positioned within said interior space of said shade, and a second portion of said plurality of illumination structures is positioned outside said interior space of said shade.

22. The method of claim 19, wherein said support structure comprises at least one support member forming a loop, and wherein said method further comprises selecting positions on said support member for joining said plurality of illumination structures.

23. The method of claim 19, further comprising placing said diffusing structure over said light source;

wherein joining said support structure to said lamp comprises one of a group consisting of joining said support structure to a socket on said lamp, joining said support structure to said light source, and joining said support structure to a harp on said lamp;

wherein said diffusing structure comprises a shade defining an interior space for receiving said light source therein, and wherein said plurality of illumination structures are joined to said lamp such that a first portion of said plurality of illumination structures is positioned within said interior space of said shade, and a second portion of said plurality of illumination structures is positioned outside said interior space of said shade beneath said shade; and wherein said support structure comprises at least one support member forming a loop, and wherein said method further comprises selecting positions on said at least one support member for joining said plurality of illumination structures.

24. A method for decorating a lamp, said lamp comprising a light source and a diffusing structure, said method comprising:

providing a support structure defining a substantially rigid loop;

joining a plurality of illumination structures to said support structure;

joining said support structure to said lamp; and placing said diffusing structure over said light source.

25. The method of claim 24, wherein said diffusing structure comprises a shade defining an interior space for receiving said light source therein, and wherein said plurality of illumination structures are joined to said lamp such that a first portion of said plurality of illumination structures is positioned within said interior space of said shade, and a second portion of said plurality of illumination structures is positioned outside said interior space of said shade.

26. The method of claim 24, further comprising providing said support structure with a plurality of concentric loops.

27. The method of claim 24, wherein joining said support structure to said lamp comprises one of a group consisting of joining said support structure to a socket on said lamp, joining said support structure to said light source, and joining said support structure to a harp on said lamp.

28. The method of claim 24, wherein joining said support structure to said lamp comprises joining said support structure to said lamp independent of said diffusing structure.

29. The method of claim 24, further comprising placing said diffusing structure over said support structure such that said support structure is covered by said diffusing structure, and said plurality of illumination structures are visible beneath said diffusing structure.

30. The method of claim 24, wherein said plurality of illumination structures and said support structure are interchangeable with other illumination structures, support structures and lamps.

31. A method for decorating a lamp, said method comprising:

providing a support structure comprising a plurality of concentric support members and means for attaching said support structure to said lamp;

joining a plurality of illumination structures to said support structure; and joining said support structure to said lamp.

32. The method of claim 31, wherein said lamp comprises a base, a light source and a shade, and wherein said method further comprises placing said shade over said light source.

33. The method of claim 31, wherein said lamp comprises a light source, and wherein said method further comprises placing said support structure beneath said light source.

34. The method of claim 33, wherein said lamp is recessed in a ceiling, and said method comprises positioning said plurality of illumination structures to be visible from beneath said ceiling.

35. The method of claim 32, wherein said shade defines an interior space for receiving said light source therein, and wherein said plurality of illumination structures are joined to said lamp such that a first portion of said plurality of illumination structures is positioned within said interior space of said shade, and a second portion of said plurality of illumination structures is positioned outside said interior space of said shade.

36. The method of claim 31, wherein joining said support structure to said lamp further comprises joining said means for attaching to one of a group consisting of a socket on said lamp, said light source, and a harp on said lamp.

* * * * *